US010741015B2

(12) United States Patent
Brandau et al.

(10) Patent No.: US 10,741,015 B2
(45) Date of Patent: Aug. 11, 2020

(54) COMPONENT MOUNTING CONFIGURATIONS FOR A GAMING MACHINE CABINET

(71) Applicant: AGS LLC, Las Vegas, NV (US)

(72) Inventors: Mark Robert Brandau, Johns Creek, GA (US); Brian Edward Tovar, Atlanta, GA (US); Adam Daniel Ambrecht, Kennesaw, GA (US); Kevin Berwick Green, Atlanta, GA (US)

(73) Assignee: AGS LLC, Las Vegas, NV (US)

( * ) Notice: Subject to any disclaimer, the term of this patent is extended or adjusted under 35 U.S.C. 154(b) by 194 days.

(21) Appl. No.: 16/044,999

(22) Filed: Jul. 25, 2018

(65) Prior Publication Data

US 2019/0096173 A1 Mar. 28, 2019

Related U.S. Application Data

(60) Provisional application No. 62/564,412, filed on Sep. 28, 2017.

(51) Int. Cl.
*G07F 17/32* (2006.01)

(52) U.S. Cl.
CPC ..... *G07F 17/3223* (2013.01); *G07F 17/3216* (2013.01); *G07F 17/3241* (2013.01)

(58) Field of Classification Search
None
See application file for complete search history.

(56) References Cited

U.S. PATENT DOCUMENTS

| | | | | |
|---|---|---|---|---|
| 6,688,964 | B2 | 2/2004 | Uemura et al. | |
| 6,997,810 | B2 | 2/2006 | Cole | |
| 7,267,613 | B2 | 9/2007 | Cole | |
| 2005/0032578 | A1 * | 2/2005 | Cole | G07F 17/32 463/46 |

* cited by examiner

*Primary Examiner* — Robert T Clarke, Jr.
(74) *Attorney, Agent, or Firm* — Weide & Miller, Ltd.

(57) ABSTRACT

A gaming machine is provided with easily installable and serviceable components. The gaming machine includes a gaming cabinet having a main door and a lower door. A lock assembly is attached to the gaming cabinet. The lock assembly has a lock support with front panel, a first side panel, and a second side panel. At least gaming machine access control device is disposed in the front panel of the lock support, and a flange is disposed on the first side panel to connect with a mount on the gaming cabinet. A hinge pin extends through the second side panel of the lock support about which the lock assembly rotates when the main door of the gaming cabinet is open. A subwoofer is slidably mounted to a platform in the gaming machine and is secured in place with a locking element via a single fastener.

10 Claims, 9 Drawing Sheets

COMPONENT MOUNTING CONFIGURATIONS FOR A GAMING MACHINE CABINET

RELATED APPLICATION DATA

This application claims priority to U.S. Provisional Application Ser. No. 62/564,412, filed Sep. 28, 2017, which is incorporated herein in its entirety by reference.

BACKGROUND

The disclosed embodiments relate to gaming cabinet features of gaming machines which are configured to present one or more games, such as wagering or casino-style games.

Many styles of gaming machines and games are known, including casual (or non-wagering) gaming and wager-based gaming. Such gaming machines have many parts which require periodic service. For example, casino-style gaming machines are tightly regulated and are secured to prevent tampering, such as having various locks and service switches that allow access to an inside of a cabinet of the gaming machine and that activate various features of a gaming machine. Service of such locks and switches has typically involved removal of one or more parts of the gaming cabinet in order to access, service, and/or change them.

For example, U.S. Pat. No. 6,688,964 describes a slant-top gaming machine having a first lock (98) for a top panel sub-door (92), a second lock (48) for a front panel (38), and at least one reset switch (130). These switches and locks are all located in different positions, thus requiring the technician to separately access them for service. In addition, at least in the case of the reset switch (130) which is located behind a front panel (38), there is no convenient access to the switch, such as for service. In these situations, the technician may be required to remove other gaming machine components (electronic features or otherwise), panels and the like, to access each switch and lock. This process can be tedious, may result in lost parts, and may otherwise damage the gaming machine during the servicing process, particularly given that in some cases casino technicians are much less familiar with the machines and their servicing than the original manufacturer. Thus, it is desirable to provide an improved mounting and access configuration for such component, such as to improve the gaming machine assembly process and to facilitate maintenance of the machine in the field.

Other parts of a gaming machine may similarly suffer from complexity during installation and service. For example, speakers such as subwoofers require complex mounting hardware including multiple fasteners and the like. As one example, a subwoofer may be mounted to a gaming machine by passing multiple threaded fasteners through mounting flanges into a panel of the gaming machine. During servicing, however, a technician must remove all those fasteners and keep track of them for re-assembly. Often, however, the technician may lose one or more of the fasteners. Also, the fasteners are often very costly, increasing the cost of adding the subwoofer feature to the gaming machine.

Another problem with existing mounting configurations for features like subwoofers is that they often interfere with the placement of other features of the gaming machine, or those other features make it difficult to access and service the subwoofer. For example, if the subwoofer is mounted directly to a bottom of the gaming machine cabinet, various cables and other features of the gaming machine may be placed along the sides of the subwoofer and thus over the mounting flanges, making it very difficult to even access the mounting fasteners. This may thus require the cabling or other features to be re-routed to other areas of the interior of the gaming machine, which can be difficult given the constrained space therein. Accordingly, there is a need for an improved gaming cabinet allowing for easy maintenance and installation of internal components such as a subwoofer.

SUMMARY

In view of the above, component mounting configurations for a gaming machine are provided. The component mountings are designed facilitate ease of installation and serviceability of the components, as well as lower costs associated therewith.

In one embodiment, a gaming machine is provided with a gaming cabinet having a main door and a lower door. A lock assembly is movably mounted to the gaming cabinet. The lock assembly may comprise a support or body having a front panel, a first side panel, and a second side panel. At least one access control device is disposed in the front panel of the lock support, and a flange disposed on the first side panel to connect with a mount on the gaming cabinet. A hinge pin extends through the second side panel of the lock support about which the lock assembly is rotatable when the main door of the gaming cabinet is open.

In some embodiments, the gaming machine further comprises a fastener connecting the flange to the mount on the gaming cabinet. The fastener may be a keyed fastener that is rotated from a first locked position to a second open position. The keyed fastener may comprise a ring extending from the fastener to aid in the rotation of the keyed fastener.

In another embodiment, the second side panel may have an arced projection extending through a bushing disposed on the gaming cabinet. The at least one access control device may comprise a main door latch control for a main door latch and a main door lock locking the main door latch control, at least one service lock controlling access to one or more permissions executable on a processor of the gaming machine, a lower door latch control and a lower door lock locking the lower door latch control.

In one embodiment, portion of the access control devices, such as latch control slides and key openings, are located at the front of the front panel, while the remaining portions of those devices are located behind the rear panel and a rear side thereof. The lock assembly may rotate from a first use position to a second service position. The front panel of the lock assembly may be substantially vertical in the use position (where the front panel faces outwardly towards the front of the gaming machine), and may be substantially horizontal with the rear side of the front panel facing upwards in the service position.

In another embodiment, a mounting configuration is provided for a gaming machine subwoofer. The mounting may include a platform. The platform may be located on the bottom of the interior of the gaming machine cabinet and may be accessible via the lower door. The subwoofer may be attached to a subwoofer mount that slidably connects to the platform. The platform may comprise a track, and the subwoofer mount may comprise hooks that selectively engage slots in the track. The platform may also include a locking device such as a lid that may be fastened to the platform adjacent to the subwoofer mount to lock the subwoofer mount to the platform, such as to prevent it from sliding laterally and allowing the hooks to disengage from the platform.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise gaming machines having gaming cabinets that include various features to facilitate maintenance and operation of the gaming machine, such as gaming machine component mounting and access features. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers, or the like.

Figure 1:
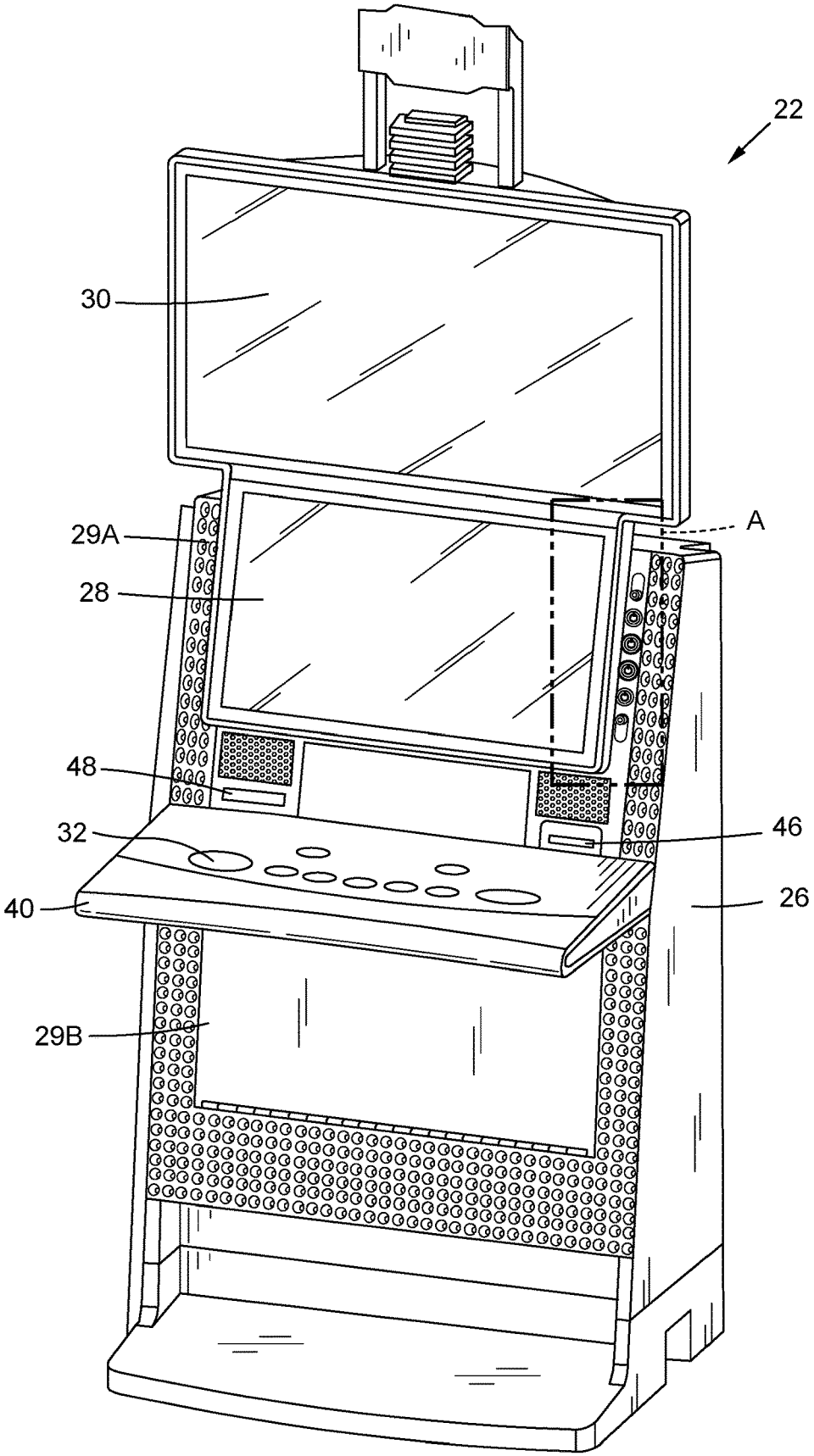
FIG. 1 is a perspective view of one embodiment of a gaming machine.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the cabinet 26 includes a first or main door 29A located at a front thereof, the door capable of being moved between an open position which allows access to the interior, and a closed position in which access to the interior is generally prevented. In the illustrated embodiment, the main door 29A is hinged on the left-hand side, permitting the door 29A to be rotated about a generally vertical axis. In this embodiment, the gaming machine 22 also includes a second or lower door 29B. This door 29B may be hinged at a bottom, permitting the door 29B to be rotated about a generally horizontal axis. As illustrated, the main door 29A may be located above a button deck 40 (which extends outwardly from the front of the cabinet 26 towards the player and may support various input devices, as described in more detail below), and the lower door 29B may be located below the button deck 40. The main door 29A may provide access to a first portion of the interior of the gaming machine 22, including some of the components thereof which are located in the interior, while the second door 29B may provide access to a second portion of the interior of the gaming machine 22, including other of the components thereof which are located in the interior thereof. Of course, the gaming machine 22 might include other configurations of doors, access panels and the like. As noted below, access to the interior of the gaming machine 22 is preferably controlled, such as by one or more locks which prevent the un-authorized opening of the doors 29A,29B. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one first display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touchscreen, a light emitting display (LED) or other suitable displays now known or later developed, in a variety of resolutions, sizes and formats (e.g. 4:3, wide-screen or the like). The display device 28 may be capable of projecting or displaying a wide variety of information, including images, symbols and other indicia or information associated with game play, game promotion or other events. The gaming machine 22 might include more than one display device, such as a main or first display device 28 and a secondary display device 30. In this embodiment, the main or first display 28 is located at the front of the main door 29A and is movable with that door. The two or more display devices might be associated with the housing or, as illustrated in FIG. 1, the second display 30 might comprise a topper mount which is mounted to and supported above the main cabinet 26 of the gaming machine 22. Also, the gaming machine 22 might include side displays (such as mounted to the exterior of the cabinet 26) and might include multiple displays of differing sizes.

While the display devices may comprise one or more video displays, in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 32 (such as input buttons, plunger mechanisms, a touch-screen display, joystick, touch-pad or the like). These one or more input devices 32 may be utilized by the player to facilitate game play, such as by providing input or instruction to the gaming machine 22. For example, such input devices 32 may be utilized by a player to place a wager, cause the gaming machine 22 to initiate a game, to initiate a reel spin, to "cash out" of the gaming machine, or to provide various other inputs. Input devices 32 may further be utilized by a game attendant or administrator to check a status of a subscription key, to remove a subscription key, or to add a new subscription key, as explained in further detail below.

Figure 2:
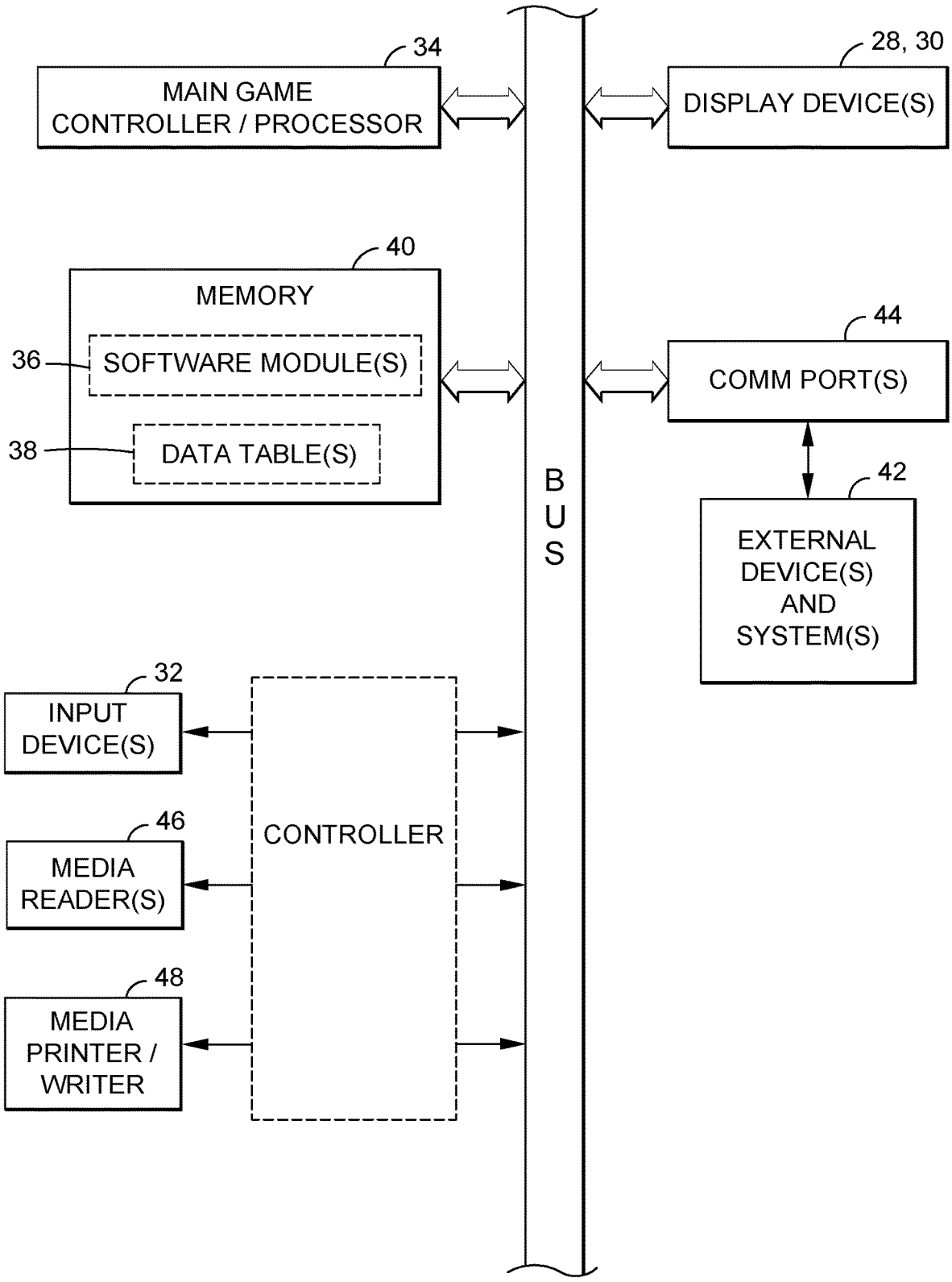
FIG. 2 diagrammatically illustrates a configuration of the gaming machine illustrated in FIG. 1.

Referring to FIG. 2, in one preferred embodiment, the gaming machine 22 includes at least one microprocessor or controller 34 for controlling the gaming machine, including receiving player input and sending output signals for controlling the various components or peripheral devices of the machine 22 (such as generating game information for display by the display devices 28,30). The controller 34 may be arranged to receive information regarding funds provided by a player to the gaming machine 22, receive input such as a purchase/bet signal when a purchase/bet button is depressed, and receive other inputs from a player. The controller may be arranged to generate information regarding a game, such as generating game information for display by the at least one display device 28, 30 (such as information comprising slot game symbols and generated multipliers), for determining winning or losing game outcomes and for displaying information regarding awards for winning game outcomes, and for validating game subscriptions, among other things.

The controller 34 may be configured to execute machine readable code or "software" or otherwise process information, such as obtained from a remote server. Software 36 or other instructions may be stored at a memory or data storage device 40, e.g. in a fixed or non-transitory configuration. The memory 40 may also store other information or data, such as data stored in table or other forms (including, but not limited to look-up tables, pay tables and other information including tracked game play information). The gaming machine 22 may also include one or more random number generators for generating random numbers (such as implemented by a random number generator software module stored in the memory 40 and executable by the processor 34), such as for use in selecting slot symbols, multiplier values, and for presenting the game in a random fashion (e.g. whereby the game is presented in a manner in which the player cannot control the outcome) or pseudo-random fashion (e.g. such as where the game includes a skill component which can affect the outcome of the game).

Preferably, the controller 34 is configured to execute machine readable code or instructions (e.g. software) which are configured to implement a game. For example, the controller 34 of the gaming machine 22 may be configured to detect a wager, such as a signal from a player's depressing of the "bet one" button which comprises one of the input devices 32. Upon such an event and/or the player otherwise signaling the gaming machine to present the game, the controller may be configured to cause the at least one display 28 to display unique information, such as a unique graphical interface or unique game display, including game symbols or other game information. The controller may accept input from a player of game inputs, such as a request to spin reels or the like, via the one or more player input devices of the gaming machine 22. As indicated above, the machine-readable code may be configured in various manners, such as by having various "modules" of software which are designed to implement specific features of the game play or game presentation.

The gaming machine 22 may be configured to generate and present games in a stand-alone manner or it may be in communication with one or more external devices or systems 42 at one or more times. The gaming machine 22 might communicate with one or more of such external devices or systems 42 via one or more communication ports 44 or other interface devices. These ports or interface devices 44 may be configured to implement various communication protocols (including proprietary protocols) and communicate via wireless, wired or other communication link. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, the gaming machine 22 might include a coin acceptor for accepting coins. Of course, associated coin reading/verifying devices and coin storage devices may be associated with the gaming machine 22 if it is configured to accept coins. Likewise, as illustrated in FIGS. 1 and 2, the gaming machine 22 might include a media reader 46. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read fobs, magnetic stripe cards, or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 22 may include one or more media printers or writers 48. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader and/or an associated keypad or other input device (such as a touch screen display). Such player tracking devices are well known and may permit the game operator to track play of players of the gaming machine. The tracked play may be utilized to offer player bonuses or awards.

As illustrated in FIG. 2, the main game controller or processor 34 may communicate with several of the peripheral devices via one or more intermediary controllers. For example, some of the peripheral devices might comprise USB type or enabled devices which are controlled by an intermediary USB controller.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIGS. 1 and 2 is only exemplary of one embodiment of a gaming machine. For example, it is possible to for the gaming machine to have various other configurations, including different shapes and styles and having different components than as just described.

Figure 3:
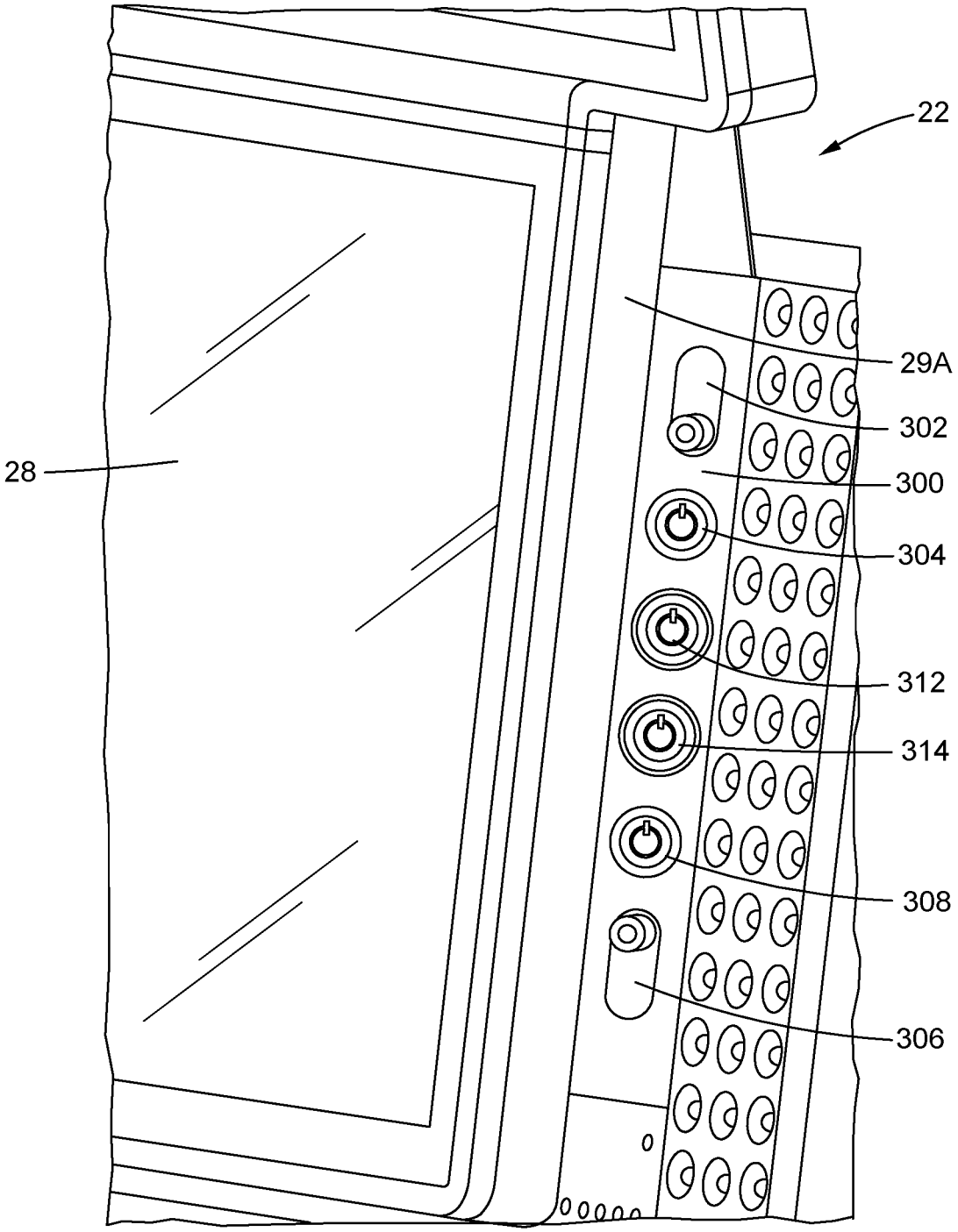
FIG. 3 is an enlarged view of the gaming machine shown in FIG. 1, according to an exemplary embodiment.

FIG. 3 shows an enlarged view of the portion of the gaming machine shown in FIG. 1 and designated by area A. The gaming machine 22 further comprises a lock assembly 300. In this embodiment, the lock assembly 300 is disposed next to the main door 29A and the associated main display 28, such as to the right-hand side thereof. The lock assembly 300 comprises one or more access control devices. In one embodiment, the access control devices comprise a main monitor release latch control 302 (which may comprise a control tab which, when slid from a first to a second position, releases a front door latch for opening the main door 29A) that is locked by a main monitor lock 304 (e.g. the latch control 302 cannot be actuated if the lock 304 is not unlocked). The main monitor lock 304 is preferably a key-actuated lock, such as where a key is inserted into the lock and rotated in order to actuate the lock. Similarly, the lock assembly 300 comprises a lower door release latch control 306 (which may comprise a control tab which, when slid from a first to a second position, releases a bottom door latch for opening the lower door 29B) that is locked by a lower door lock 308 (e.g. the latch control 306 cannot be actuated if the lock 308 is not unlocked). The lower door lock 308 is also preferably a key-actuated lock. The latch controls 302, 306, when actuated, allow an operator to open the main door 29A and lower door 29B, such as to gain access to portions of the interior area of the gaming machine cabinet, such as to access components of the gaming machine therein for repair or maintenance.

The one or more access control devices of the lock assembly 300 may further comprise a first service key lock 312 and a second service key lock 314. These service key locks 312,314 are also preferably key-operated locks. The service key locks 312, 314 may grant access to administrator menus (which may be generate by the controller of the gaming machine and displayed on the main display 28) to allow a maintenance worker, a manufacturer, a gaming operator, or the like to modify settings or otherwise access functions of the gaming machine reserved for such persons. When the first service key lock 312 is accessed or actuated, the gaming machine may grant a first set of administrator permissions, and when the second key lock 314 is accessed or actuated, the gaming machine may grant a second set of administrator permissions. Each of the locks 304, 308, 312, and 314 may be color coded (or otherwise marked or designated) to easily distinguish between the locks 304, 308, 312, and 314. For example, the main monitor lock 304 may be white, the lower door lock 308 may be black, the first service key lock 312 may be green and the second service key lock 314 may be red (and for example, associated keys may be similar color-code matched). The colors are of course exemplary, and other colors or markings may also be used according to user preferences and procedures.

Figure 4:
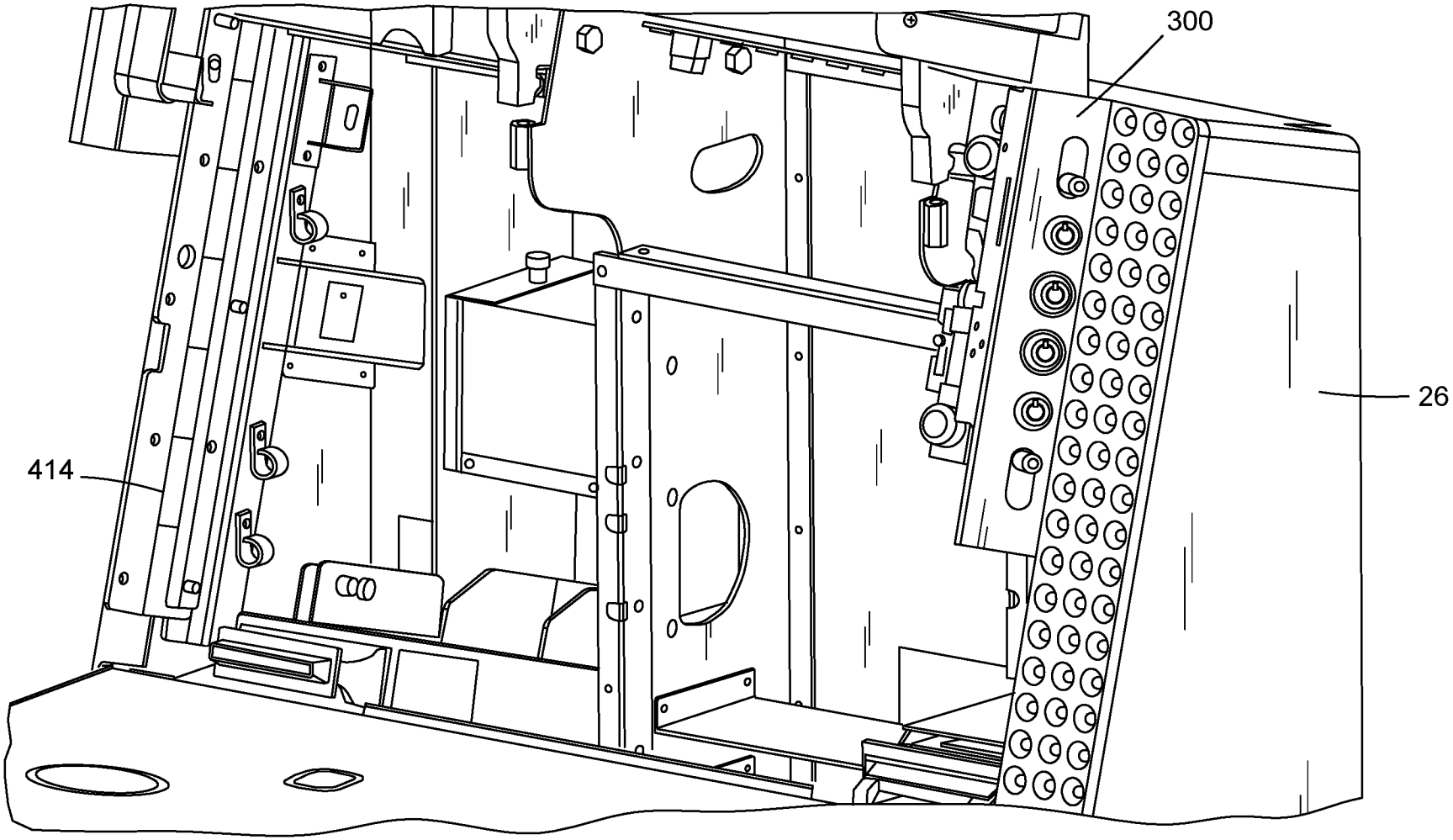
FIG. 4 shows a gaming machine with a main monitor door removed, according to an exemplary embodiment.

FIG. 4 shows a gaming machine with a main door 29A opened. In FIG. 4, the main monitor door 29A is opened to show the inside of the gaming cabinet 26. While not shown, the main monitor door 29A may be opened by accessing or actuating the main monitor lock 304 and actuating the monitor release latch control 302. The main door 29A and associated main display or monitor 28 may then rotate about the hinge 414 to provide access to the gaming cabinet 26. This also allows complete access to the lock assembly 300.

Figure 5:
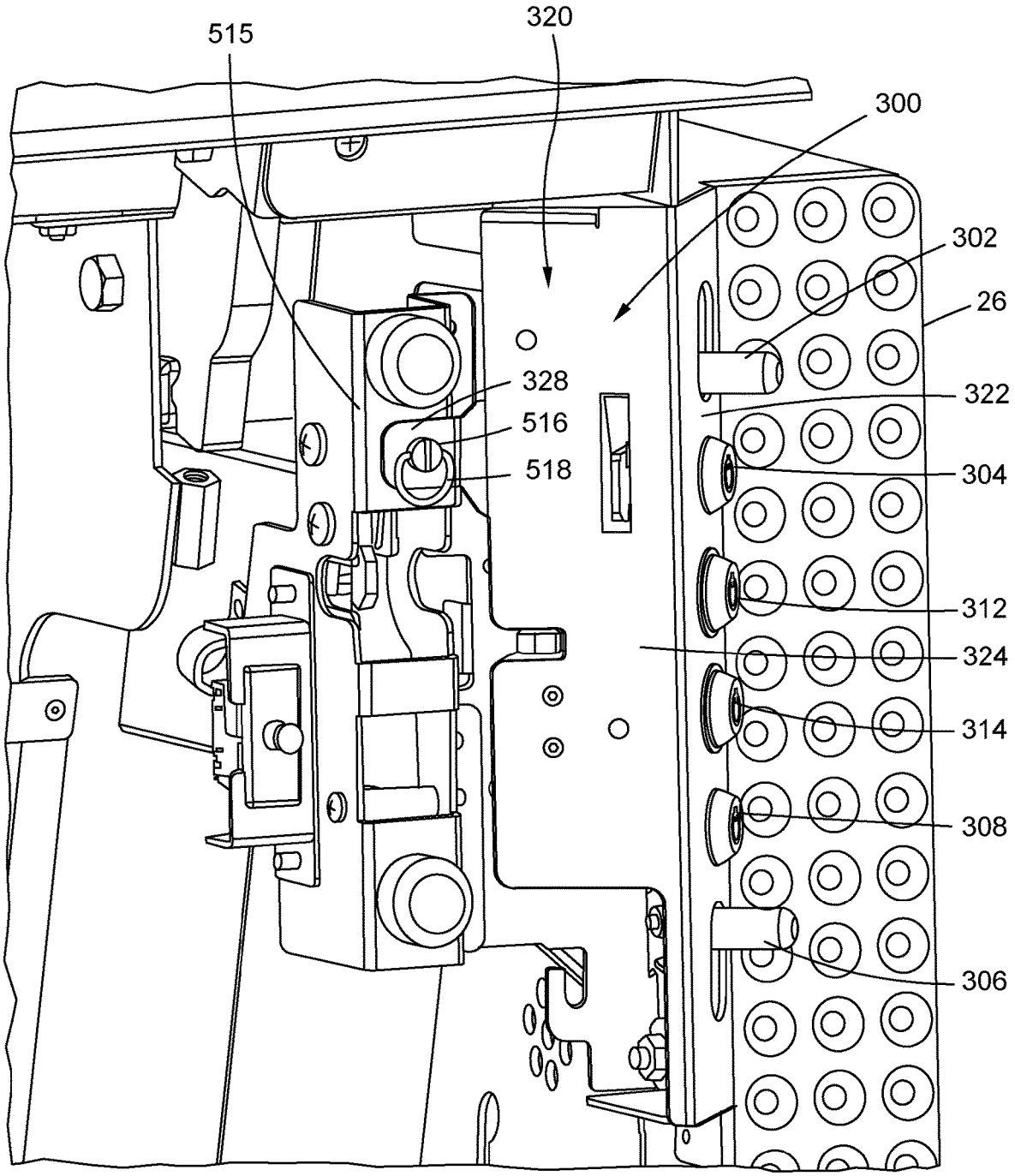
FIG. 5 shows a close-up view of a lock assembly of the gaming machine with the main monitor door removed, according to an exemplary embodiment.

FIG. 5 shows a close-up view of a lock assembly of the gaming machine with the main monitor door 29A opened. In one embodiment, the access control devices, such as the above-described locks 304, 308, 312, 314 and the latch controls 302, 306, are mounted to a lock body or support 320. The support 320 defines or has a front panel 322 and a first side panel 324 and a second side panel 326 (visible in FIGS. 6 and 7). In one embodiment, the latch controls 302, 306 extend out of the front of the front panel 322, as do the key-accepting portions of the locks 304, 308, 312, 314. The associated portions of those components are located behind the front panel 322.

Figure 6:
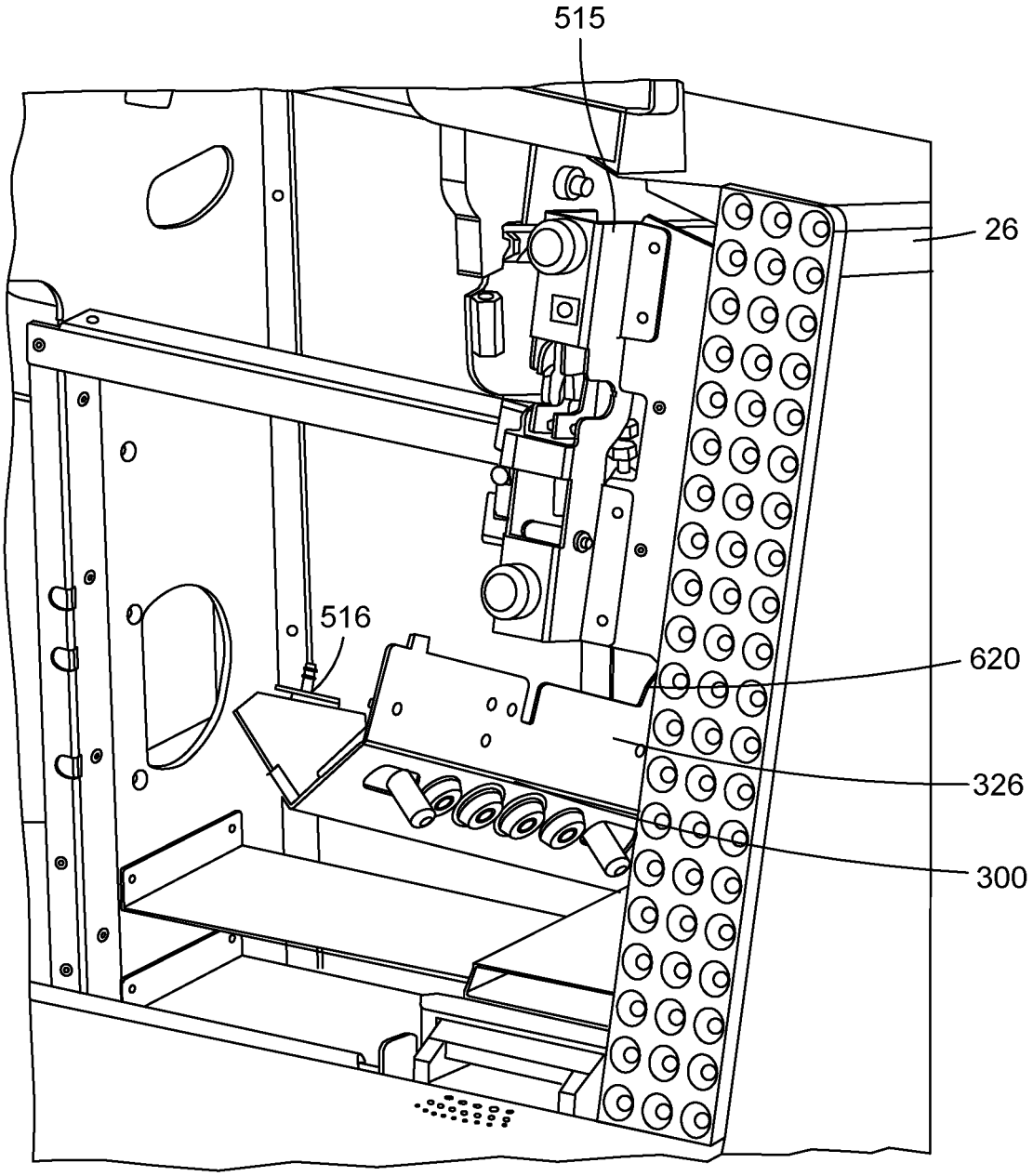
FIG. 6 shows a gaming cabinet with a lock assembly in a service position, according to an exemplary embodiment.

In a preferred embodiment, the lock body or support 320 is movably mounted to the gaming machine cabinet 26, so as to be movable between a first, normal use position (shown in FIG. 5), and a second maintenance or service position (shown in FIG. 6). In one embodiment, the lock body or support 320 is rotatably mounted to the gaming machine cabinet 26. In one embodiment, an upper portion of the locking assembly 300 is attached to the gaming cabinet 26 via a mount or flange 328. The mount or flange 328 may, for example, extend outwardly from the first side 322 of the lock body or support 320 over a bracket 515 which is mounted to the cabinet 26. In this embodiment, a keyed fastener 516 may extend through the flange 328 and into engagement with the bracket 515. The keyed fastener 516 may be a quarter-turn fastener that may be pulled out from the bracket 515 when rotated from a locked position to an unlocked position. The keyed fastener 516 may include a ring 518 to aid the operator in rotating the keyed fastener 516 from the locked to the unlocked orientation and back again.

FIG. 6 shows a gaming cabinet with a lock assembly 300 in a service position. Once the keyed fastener 516 is rotated to the unlocked position, the entire lock assembly 300 may be rotated forward, away from the bracket 515 and the gaming machine cabinet 26 to expose a rear side of the lock assembly 300. In this embodiment, the locking assembly rotates via an arced projection 620 that extends from the second side 326 of the locking assembly.

Figure 7:
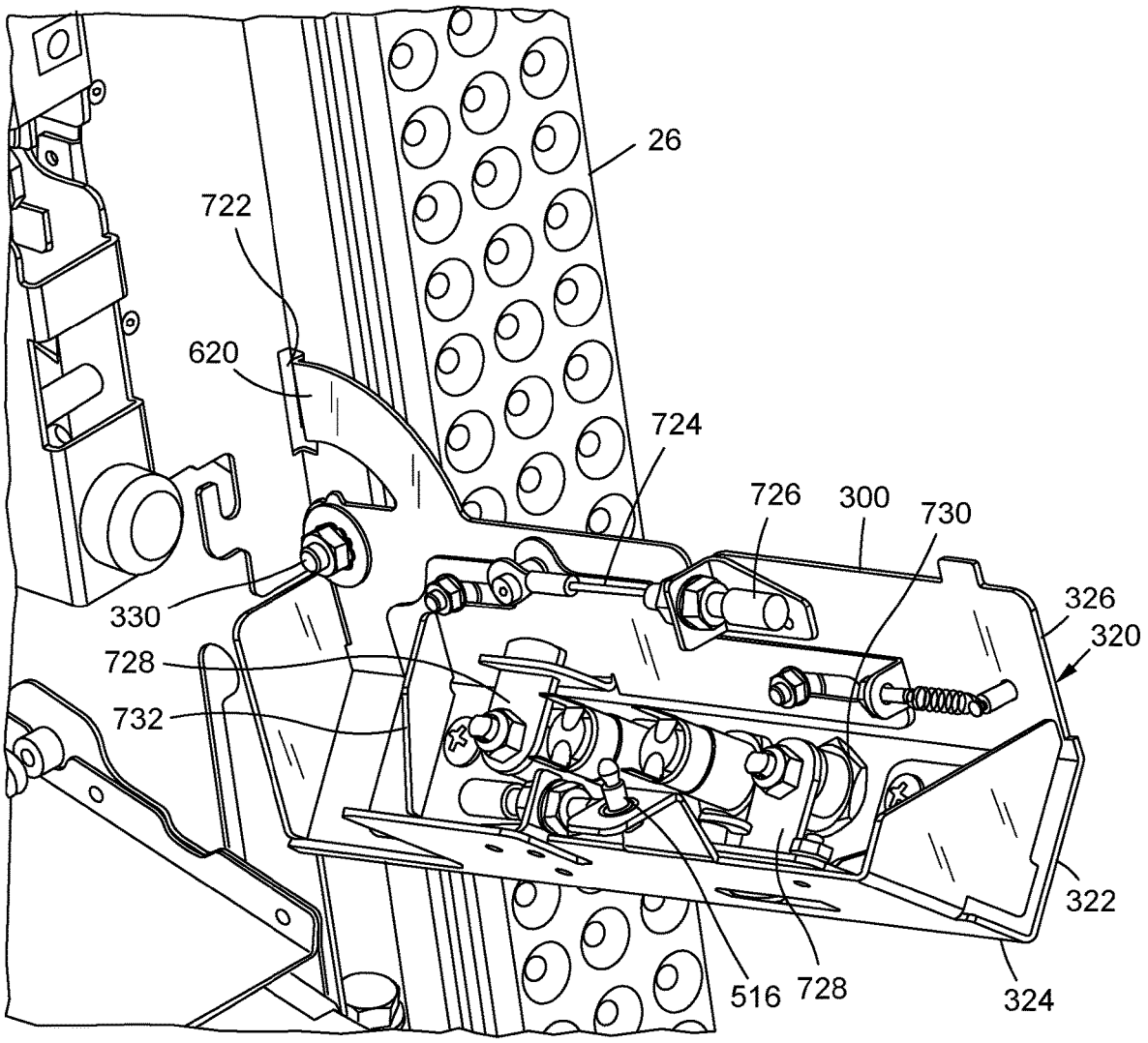
FIG. 7 shows second view of the lock assembly in the service position, according to an exemplary embodiment.

FIG. 7 shows more details of the movable mounting of the lock assembly 300, wherein the lock assembly 300 is again illustrated in the service position. As shown in FIG. 7, body 320 of the lock assembly 300 is rotatably mounted to the gaming machine cabinet 26, such as about the shank of a fastener or hinge pin 330 which is supported by the gaming machine cabinet 26 and passes through an aperture in the second side 326 of the body 320. The range of movement or rotation of the body 320 may be limited, such as by the arced projection 620. The arced projection 620 may travel through bushing 722 to allow the lock assembly 300 to rotate away from the gaming cabinet 26. A stopping mechanism (not shown) such as an enlarged stop on the end of the arced projection 620 from the body 320, which stop is too large to pass through the bushing 722, may constrain the motion of the lock assembly 300 to a desired service position. In some embodiments, springs may be added in combination with bushing 722 to aid in the smooth rotation of the lock assembly 300. Desirably, the lock assembly 300 is rotatable to a position where a rear of the front face 322 of the body 320, is accessible.

With the lock assembly 300 in the service position, maintenance or repair may be completed on various components of the lock assembly 300. In this embodiment, the lock assembly 300 comprises one or more cables 724 and cable jam nuts 726 which may be accessed when the lock assembly 300 is in the service position. The lock assembly 300 further comprises one or more lock cams 728, lock nuts 730, and lock slides 732 on a rear side that are made accessible in this configuration. With this access, a maintenance worker may service the various components to tighten, loosen, change, attach wires, detach wires, adjust lock cable tension, and so forth for all the locks on the lock assembly 300.

When maintenance on one or more of the components is complete, the lock assembly 300 may be rotated back towards the gaming cabinet 26 and attached back to the bracket 515 with the keyed fastener 516, as shown in FIG. 5.

This aspect of the invention has a number of advantages. First, the lock assembly 300 provides a convenient mounting for all of the lock, latch, and switch features of the gaming machine. These features are thus provided in a single location, rather than multiple locations about the gaming machine.

Second, as noted above, the lock assembly 300 is movable between a use position and an access or service position. In the use position, the lock assembly 300 may be generally vertically positioned, such as extending in the same plane as the adjacent portion of the cabinet 26 (see e.g. FIG. 3). In this position, a front face 322 of the lock assembly 300 faces outwardly and provide convenient access to operation of the switches, latches and locks. Most importantly, however, the lock assembly 300 can be moved to a service position where those features can be serviced, such as by accessing the back portions of those elements. In one embodiment, this comprises rotating the lock assembly 300 about a horizontal axis downwardly until a back of the front face is accessible.

Another advantage to the lock assembly 300 is its simplicity. For example, the lock assembly 300 comprises a simple body 320, such as made or stamped from metal. It can be mounted for rotation via a single pin. The lock assembly 300 thus has a low cost of manufacture and is easy to install during manufacture.

It will be appreciated that the lock assembly might have other configurations while still maintaining these advantageous features. For example, other rotation stop features might be provided other than the sliding arced projection, such as a short cable which becomes taunt and prevents over-rotation of the assembly (though the arced projection feature facilitates smoother rotation or movement of the assembly as it slides through the bushing, thus preventing the assembly from rotating too quickly and banging down to a stop). Also, it is possible for the body of the lock assembly to have other shapes and for it to be mounted in other locations (for example, if the main door opened to the right inside of the left, the lock assembly could be moved to the left side of the main door).

Figure 8:
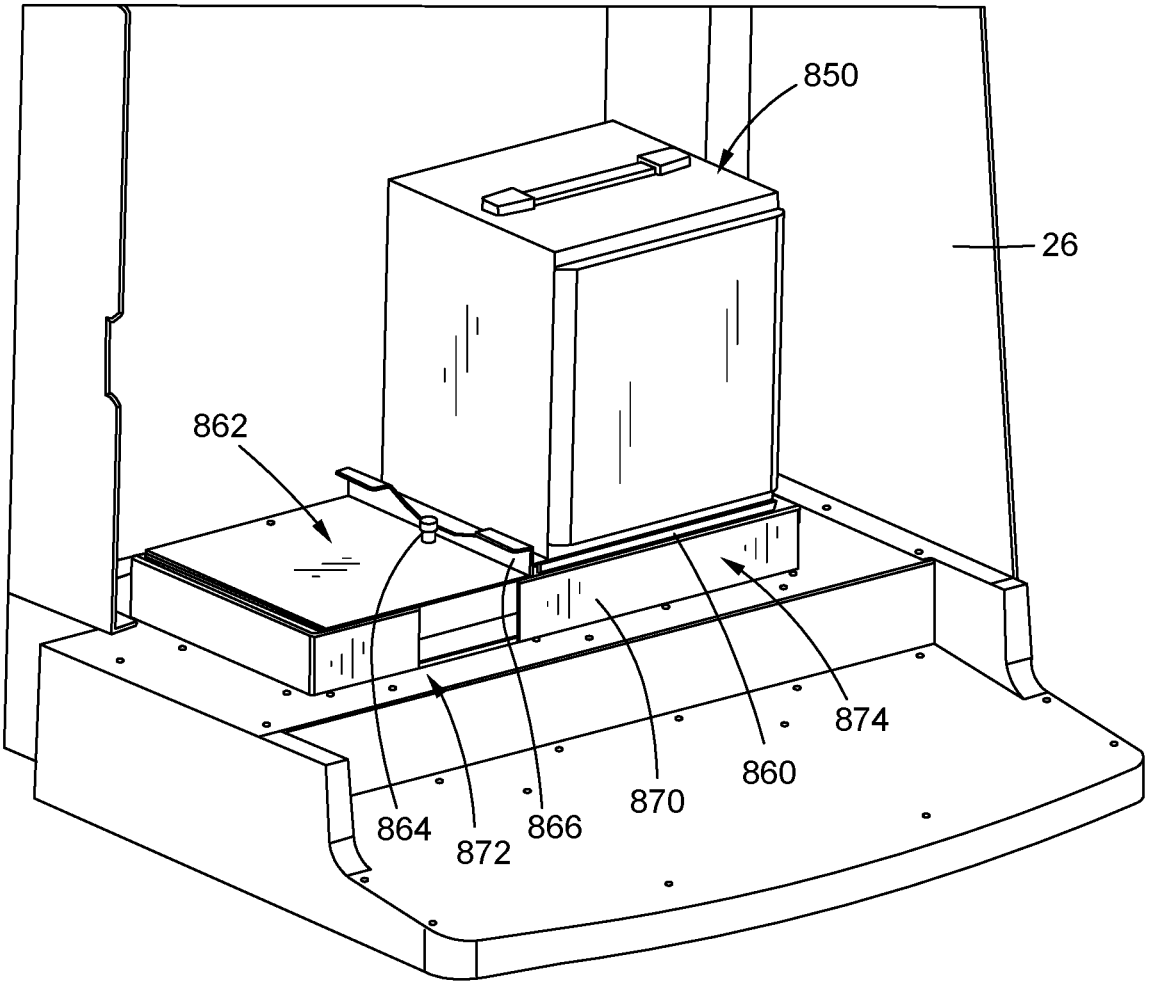
FIG. 8 shows a view of an inside of a lower portion of a gaming cabinet, according to an exemplary embodiment.

The gaming cabinet 26 provides additional features to enable easier assembly and maintenance of the gaming machine. FIG. 8 shows a view of an inside of a lower portion of a gaming cabinet, according to an exemplary embodiment. This portion of the gaming machine 22 might be accessible, for example, by opening the lower door 29B illustrated in FIG. 1). In one embodiment, the gaming machine 22 may include a sound system for generating sounds. The sound system may include one or more speakers, such as a subwoofer speaker 850.

As shown in FIG. 8, the subwoofer speaker 850 may be disposed in the lower portion of the gaming cabinet 26. Preferably, a subwoofer speaker mount is provided which enables the subwoofer speaker 850 to be easily and securely connected to the cabinet 26 of the gaming machine 22, and to be conveniently disconnected therefrom, such as for service or replacement.

In one embodiment, the subwoofer speaker 850 is designed to be mounted to a base or platform 870. The platform 870 may be mounted, for example, to a bottom of the gaming machine cabinet 26 and provides a support for the subwoofer speaker 850, such as in a slightly raised position. As illustrated, the platform 870 is elongate and defines or has a first lock or lid mounting area 872 and a second subwoofer speaker mounting area 874. In general, the subwoofer speaker 850 is attached to a slidable mount 860. The mount 860 slides into position from left to right as shown in FIG. 8, e.g. from the direction of the lid area 872 towards the speaker area 874. The subwoofer mount 860 is then secured in the subwoofer speaker area 874 by a locking element, such as a lid 862. In one embodiment, the lid 862 is secured to the platform 870 by a single removable fastener 864 for simplicity of installation. The lid 862 may have a flanged end 866 at its end or side that abuts the mount 860 to lock the mount 860 into place by preventing the mount 860 from sliding back laterally towards the lock or lid area 872 and becoming disconnected from the platform 870.

Figure 9:
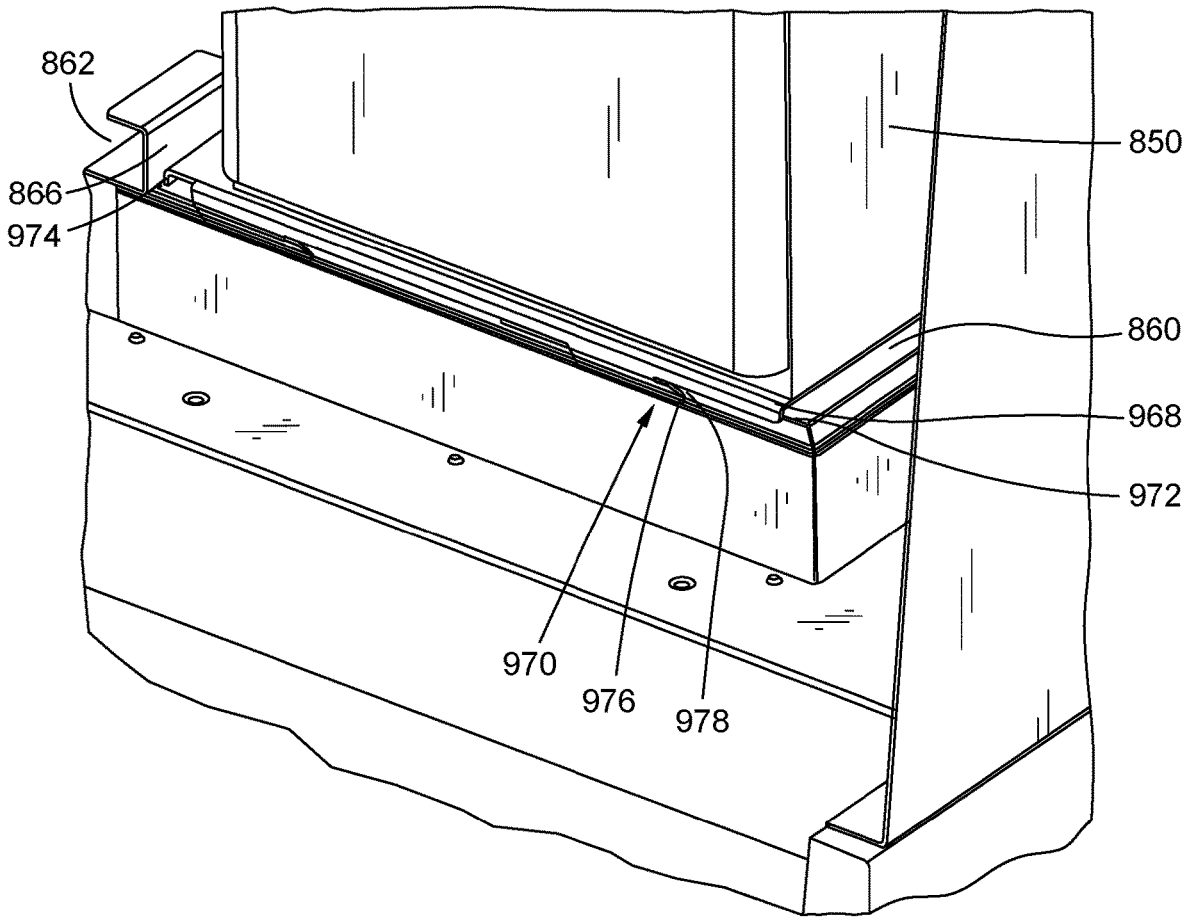
FIG. 9 shows a close up of a subwoofer in a lower portion of the gaming cabinet, according to an exemplary embodiment.

FIG. 9 shows a close up of the subwoofer mount 860, according to an exemplary embodiment. As shown in FIG. 9, the mount 860 has a top and a bottom. The subwoofer speaker 850 is located at the top side, such as by fixedly mounting it to the mount 860 via fasteners or connectors. The mount 860 defines one or more rail followers 968, such as at the front and back edges thereof. One or more hooks 970 extend downwardly therefrom below the bottom side of the mount 860, each hook 870 defining a catch 976 which is spaced from the bottom of the mount 860 by a slot 978. In this configuration, the rail follower(s) 968 is designed to slide along a corresponding track or edge 972 of the mount 860. This track or edge defines one or more slots therein which are sized to accept the hooks 970. The installer slides the mount 860 along the platform 970 from the lid mounting area 972 towards the subwoofer speaker mount area 974 (e.g. from left to right in FIG. 9) until the hooks 970 fall into the slots. The installer then pushes the mount 860 until portions of the mount 860 engage or fit into the slot 978 of each hook 970. At that time, the catch 976 is positioned under a bottom portion of the mount 860 at a forward end (right side in FIG. 9) of the slot in the mount 860, thus constraining the mount 860 in the vertical direction. In particular, the subwoofer mount 860 cannot move upwardly because the catch 976 of each hook 970 catches or hits the bottom of the subwoofer mount 860.

In order to retain the subwoofer speaker 850 in the subwoofer mounting area 874 of the platform 870, the lid 862 is placed against or adjacent (preferably laterally adjacent) to the subwoofer mount 860 in the lid or lock mounting area 872 of the platform 872. When the subwoofer 850 is in its mounted position, the flange 866 of the lid 862 interacts with a step 974 of the mount 860 to constrain the mount 860 in the horizontal direction (e.g. the mount 860 is prevented from sliding back out of engagement with the platform 970 towards the lid mounting area 972).

In accordance with the invention, a subwoofer speaker mounting configuration is provided which allows a subwoofer speaker to be quickly and easily installed in the gaming machine cabinet with a single fastener (the fastener which affixes the lid to the platform). This results in a reduction in assembly time of the gaming machine as well as ease of maintenance of the subwoofer 850. In addition, the cost associated with the subwoofer feature of the gaming machine is reduced by eliminating multiple costly fasteners as in the prior art. The configuration also provides a more effective use of space for network cables and switches in the gaming machine cabinet and aids in clean cable management. For example, because the subwoofer is mounted on a slightly raised platform, cables and other elements of the gaming machine can be routed along the bottom of the cabinet around the platform without interfering with the ability to still install and remove the subwoofer.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a gaming cabinet having a main door and a lower door;

a lock assembly attached to the gaming cabinet, the lock assembly comprising:

a lock support having a front panel, a first side panel, and a second side panel;

at least one access control device connected to the front panel of the lock support, a first portion of the at least one access control device located at a front of the front panel and second portion of the access control device located at a rear of the front panel; and a flange disposed on the first side panel to connect with a mount on the gaming cabinet; and a hinge pin extending through the second side panel of the lock support about which the lock assembly is rotatable when the main door of the gaming cabinet is open.

2. The gaming machine of claim 1, further comprising a fastener connecting the flange to the mount on the gaming cabinet.

3. The gaming machine of claim 2, wherein the fastener is a keyed fastener that is rotated from a first locked position to a second unlocked position.

4. The gaming machine of claim 3, wherein the keyed fastener comprised a ring extending from the fastener to aid in the rotation of the keyed fastener.

5. The gaming machine of claim 1, wherein the second side panel further comprises an arced projection extending through a bushing disposed on the gaming cabinet.

6. The gaming machine of claim 1, wherein the at least one access control device comprises a main door latch control for a main door latch and a main door lock locking the main door latch control, at least one service lock controlling access to one or more permissions executable on a processor of the gaming machine, a lower door latch control and a lower door lock locking the lower door latch control.

7. The gaming machine of claim 1, wherein the lock assembly rotates from a first use position to a second service position, wherein the front panel of the lock assembly is substantially vertical in the use position with the front of the front panel facing outwards and is generally horizontal in the service position with the rear of the front panel facing upwards.

8. The gaming machine of claim 1, further comprising a subwoofer disposed on a platform of the gaming cabinet, the platform being accessible via the lower door, the subwoofer being attached to a subwoofer mount that slidably connects to the platform.

9. The gaming machine of claim 8, wherein the platform comprises a track and the subwoofer mount comprises hooks that selectively engage slots in the track.

10. The gaming machine of claim 8, further comprising a lid fastened to the platform laterally adjacent to the subwoofer mount to lock the subwoofer mount to the platform.

* * * * *